US010549537B2

(12) United States Patent
Van De Kruijs et al.

(10) Patent No.: US 10,549,537 B2
(45) Date of Patent: Feb. 4, 2020

(54) METHOD FOR MANUFACTURING A PRINTING BAR UNIT FOR A PRINTING SYSTEM, AND A PRINTING BAR UNIT

(71) Applicant: SPGPrints B.V., Boxmeer (NL)

(72) Inventors: Franciscus Wilhelmus Johanna Gerardus Van De Kruijs, Deurne (NL); Martinus Gerardus Jozef Manders, Boxmeer (NL); Corné Geert Jan Scholten, Elst (NL)

(73) Assignee: SPGPrints B.V., Boxmeer (NL)

( * ) Notice: Subject to any disclaimer, the term of this patent is extended or adjusted under 35 U.S.C. 154(b) by 30 days.

(21) Appl. No.: 15/532,737

(22) PCT Filed: Dec. 4, 2015

(86) PCT No.: PCT/NL2015/050843

§ 371 (c)(1),
(2) Date: Jun. 2, 2017

(87) PCT Pub. No.: WO2016/089211

PCT Pub. Date: Jun. 9, 2016

(65) Prior Publication Data

US 2017/0348971 A1 Dec. 7, 2017

(30) Foreign Application Priority Data

Dec. 5, 2014 (NL) ..... 2013931

(51) Int. Cl.
*B41J 2/155* (2006.01)
*B41J 2/045* (2006.01)
(Continued)

(52) U.S. Cl.
CPC ..... *B41J 2/155* (2013.01); *B41J 2/04505* (2013.01); *B41J 2/14024* (2013.01);
(Continued)

(58) Field of Classification Search
CPC ..... B41J 2/155; B41J 2/1752; B41J 2/14024; B41J 2/1621; B41J 2/04505; B41J 2202/20; B41J 2202/19; B41J 2202/08
See application file for complete search history.

(56) References Cited

U.S. PATENT DOCUMENTS 6,409,307 B1 6/2002 Akhavain et al.
9,150,021 B2 * 10/2015 Ishii ..... B41J 2/145
(Continued)

FOREIGN PATENT DOCUMENTS

GB 2449939 A 12/2008
JP 2008-296518 A 12/2008
(Continued)

*Primary Examiner* — Huan H Tran
(74) *Attorney, Agent, or Firm* — Hoffmann & Baron, LLP

(57) ABSTRACT

A method for manufacturing a printing bar unit for a printing system includes the steps of providing a support bar having a plurality of primary mounting positions, providing a plurality of exchangeable printheads having a plurality of inkjet nozzles, and releasably mounting the printheads to the support bar. Preceding the step of releasably mounting the printheads to the support bar, a plurality of reference organs are connected at the primary mounting positions to the support bar and undergo an alignment finishing process for forming a plurality of accurate secondary mounting positions, and then in a subsequent step the printheads are releasably mounted to the secondary mounting positions on the reference organs. A dimensional tolerance of the secondary mounting positions on the reference organs relative to each other is more accurate than a dimensional tolerance of the primary mounting positions on the support bar relative to each other.

22 Claims, 8 Drawing Sheets

(51) Int. Cl.
*B41J 2/14* (2006.01)
*B41J 2/16* (2006.01)
*B41J 2/175* (2006.01)

(52) U.S. Cl.
CPC ..... *B41J 2/1621* (2013.01); *B41J 2/1752* (2013.01); *B41J 2202/08* (2013.01); *B41J 2202/19* (2013.01); *B41J 2202/20* (2013.01)

(56) References Cited

U.S. PATENT DOCUMENTS

| | | | | |
|---|---|---|---|---|
| 2011/0316930 | A1 | 12/2011 | Corley et al. | |
| 2012/0069090 | A1 | 3/2012 | Shinozaki | |
| 2013/0265363 | A1* | 10/2013 | Ishii et al. ..... | B41J 2/145 |
| 2014/0168303 | A1 | 6/2014 | Moreau et al. | |

FOREIGN PATENT DOCUMENTS

| | | | |
|---|---|---|---|
| JP | 2009-149057 | A | 7/2009 |
| JP | 2010-137520 | A | 6/2010 |
| JP | 2011-168012 | A | 9/2011 |
| JP | 2017-528892 | A | 9/2017 |
| JP | 2017-536269 | A | 12/2017 |
| WO | 2014/160219 | A1 | 10/2014 |
| WO | 2016/049305 | A1 | 3/2016 |
| WO | 2016/089211 | A1 | 6/2016 |

* cited by examiner

Fig. 4B"

METHOD FOR MANUFACTURING A PRINTING BAR UNIT FOR A PRINTING SYSTEM, AND A PRINTING BAR UNIT

CROSS-REFERENCE TO RELATED APPLICATIONS

This application is the National Stage of International Application No. PCT/NL2015/050843 filed Dec. 4, 2015, which claims the benefit of Netherlands Application No. NL 2013931, filed Dec. 5, 2014, the contents of which is incorporated by reference herein.

FIELD OF THE INVENTION

The invention relates to a method for manufacturing a printing bar unit for a printing system as well as to a printing bar unit, in which the printing bar unit is of the type that has a plurality of exchangeable printheads, of which each printhead has a plurality of inkjet nozzles. This makes it possible to exchange one or more of the printheads should one or more of the nozzles therein get out of order, thus not having to replace the entire printing bar unit. Such printing bar units can be used in single pass inkjet printing systems in which a substrate to be printed is moved in a direction x along a printhead unit which extends in a direction y over an entire width of the substrate. Such printing bar units can also be used in scanning type of inkjet printing systems in which a substrate to be printed is moved stepwise in a direction x along a printhead unit which may be smaller than a width of the substrate, and in which the printhead itself then can be moved in a direction y, perpendicular to a main substrate direction x, in order to be able to print an entire width of the substrate.

BACKGROUND OF THE INVENTION

For single pass type printing of substrates, printing systems are known to comprise elongate lineheads with stationary rows of inkjet nozzles. For larger widths, such lineheads each comprise an elongate support bar that is equipped with a plurality of printheads, of which each printhead is replaceable and comprises a number of the nozzles. It is of great importance for the image quality that can be obtained with printing on a substrate, that each printhead is accurately positioned, both relative to printheads of their own linehead as well as relative to printheads of other lineheads. Dimensional stability of the nozzle locations in the printheads in the printing direction x as well as in a direction y perpendicular thereto is crucial. Another important aspect is that the support bar needs to have an expansion behaviour that is matched to the printheads, and any intermediate connection elements therebetween, during changes of temperature. This is important in order to prevent that, transitions between respective printheads become visible on a printed substrate if a pitch between two nozzles of two adjacent printheads becomes different from a pitch between two nozzles of a same printhead. This is also important because, in the case that each printhead is mounted to the support bar with two or more interspaced mounting positions in the y-direction, the support bar may start to curve in the case of such temperature changes. Moreover, considering two or more lineheads from the same system may have different temperatures but the nozzles on these lineheads have to stay aligned, it is often preferred that the support bar have a low thermal expansion coefficient and high thermal conduction. Furthermore, considering the linehead may span a large width, it is preferred that the support bar has a high e-modulus and is lightweight.

For example US 2013/0265363 shows a printing bar unit which comprises a T-shaped support bar which at both sides of a vertical portion is provided with four engagement recesses. Each recess can receive a complementary engagement projection of a printhead, substantially with a form fit. Each recess furthermore is provided on its opposite edges with tapped holes for mounting one of the printheads thereto. For this each printhead includes a printhead body that is able to eject ink from an array of inkjet nozzles, and a fixing member. The fixing member is pre-mounted to the printhead body with screws. A horizontal portion of the T-shaped base plate is provided with communication holes which are connectable to ink channels of the printheads. The communication holes connect to an ink supply tube. Inside the printheads the inkjet nozzles are each equipped with a controllable piezoelectric element.

A disadvantage herewith is that the printing bar unit is difficult and expensive to manufacture, particularly if the unit needs to span large printing widths, as for example may be the case when it is to be used as elongate linehead for single pass type of printing, in which the linehead needs to span the entire width of substrates to be printed. Furthermore it is disadvantageous that a high positioning accuracy of each of the individual printheads relative to the support bar is strongly dependent on the accuracy with which the support bar itself is manufactured and is strongly dependent on the rigidity of the support bar during use, for example when heating of the unit may occur.

GB-2,449,939 discloses a method for manufacturing a printhead support, in which an elongated support member is provided with connecting apertures that are positioned approximately where corresponding printhead alignment members are to be located. This support member gets placed on top of a jig in such a way that the connecting apertures get positioned around accurately located upwardly projecting spigots of the jig. With this the connecting apertures have a larger diameter than the corresponding spigots. Gaps between the spigots and the connecting apertures then get filled with a hardenable material. As soon as this material has hardened, the support member gets removed from the jig leaving mounting apertures behind where the spigots were located. Those mounting apertures then are destined for having printheads mounted thereto with their printhead alignment members.

A disadvantage with this is that the support member needs to be held securely in place on the jig not only during filling of the gaps with the hardenable material but also during hardening thereof. The slightest movement between the support member and the jig, immediately deteriorates the positioning accuracy of the to be formed mounting apertures. Another disadvantage is that for the hardening of the material, heating and/or curing is necessary, which may cause the support member and/or the jig to expand/deform, which then immediately may have a negative effect on the positioning accuracy of the to be formed mounting apertures. Yet another disadvantage is that measures need to be taken in order to prevent the hardenable material from sticking to the jig. Further it is noted that with this method the degree of positioning accuracy may leave to be desired, for example due to variations or deviations in shrinkage of the hardenable material during hardening. Also it is noted that the hardenable material needs to be from a specific type that is able to harden to a sufficient high and accurate degree, like Diamant Moglice, which makes it relative expensive.

There also needs to be access to insert the hardenable material whereas the geometry not always permits to have insertion holes and excess spill apertures. Finally it is noted that the filling of the gaps with the hardenable material is a relative difficult and time-consuming operation which is likely to contaminate the support member at locations around the connecting apertures.

SUMMARY OF THE INVENTION

The present invention aims to at least partly overcome the above mentioned disadvantages, or to provide a usable alternative. In particular it aims to provide an economic high precision manufacturing method for printing bar units as well as to provide printing bar units with which a higher accuracy of printing can be achieved without this having to incur high manufacturing costs.

This aim is achieved by a method for manufacturing a printing bar unit for a printing system according to the present invention. This method comprises the steps of providing a support bar having a plurality of primary mounting positions, of providing a plurality of exchangeable printheads, in which each printhead has a plurality of inkjet nozzles, and of releasably mounting the printheads to the support bar. According to the inventive thought the method is characterized in that, preceding the step of releasably mounting the printheads to the support bar, a plurality of reference organs are connected at the primary mounting positions to the support bar and during this connection or directly thereafter undergo an alignment finishing process for forming a plurality of accurately lined up secondary mounting positions. Only then in a subsequent step, the printheads are releasably mounted to those accurately lined up secondary mounting positions on the reference organs.

Thus it is advantageously possible to make the support bar and its primary mounting positions thereon with relative high thermal stability but also with yet relative inaccurate dimensional tolerances. The subsequent connection and alignment finishing process of the reference organs onto the support bar, is well able to lift those relative inaccurate dimensional tolerances of the primary mounting positions on the support bar to higher accuracy levels of the secondary mounting positions that are then formed by or on the reference organs. This makes it possible to even use lengths of standard profiles as support bars, making them relative cheap to manufacture. Also this makes it possible to drill relative large and/or inaccurate holes in the support bar for forming its primary mounting positions. The support bar can even be made from a material that is more rigid and/or more lightweight compared to the material of the reference organs. Furthermore the support bar can be made from a material that has a higher thermal stability (smaller coefficient of thermal expansion) and/or higher thermal conduction coefficient relative to the ones of the reference organs. The reference organs themselves can be formed by relative small elements compared to the support bar. This makes their influence on a deformation behaviour of the entire unit small. They may even be made of a material that is less thermally stable compared to the material of the support bar, that is to say a material that has a higher coefficient of thermal expansion. Further, the reference organs can be formed by elements that can easily undergo the required accurate alignment finishing process during and/or after connection to the support bar. Also any length differences or shape differences of the support bar, thus can easily be dealt with.

In a preferred embodiment the alignment finishing process of the method according to the invention comprises a machining operation, that is to say a controlled material-removal process, preferably with the aid of machine tools, in which the alignment-finishing of the reference organs takes place by means of an active removal of material of those reference organs in order to form the plurality of accurately lined up secondary mounting positions. In particular this machining operation then may comprise a face milling and/or grinding step of at least those parts/faces of the reference organs to which the printing heads are destined to get releasably mounted to. Such face milling and/or grinding are able to achieve a high degree of accuracy and are considered efficient, reliable and economic methods for performing said aimed alignment finishing process. The grinding preferably uses a grinding wheel and may include a process of polishing, for example one that starts with coarse abrasives and graduates to fine ones. Other types of machining or combinations thereof are however also possible, like drilling, reaming, planing or sawing. In the alternative, the alignment finishing process may also comprise a process of controlled material addition to at least those parts of the reference organs to which the printing heads are destined to get releasably mounted to.

In a preferred embodiment the alignment finishing process of the reference organs may be performed such that dimensional tolerances of the secondary mounting positions on the reference organs relative to each other become more accurate than dimensional tolerances of the primary mounting positions on the support bar relative to each other. With dimensional tolerance it is meant here the degree of accuracy with which the positions in x-, y- and/or z-directions of the primary and secondary mounting positions have come to lie relative to each other. For example this can be the accuracy of an aimed interspacing distance in a certain x-, y- and/or z-direction between two adjacent primary or secondary mounting positions. In particular the dimensional tolerances of the primary mounting positions on the support bar then may be larger than 0.1 mm, whereas the dimensional tolerances of the secondary mounting positions may become smaller than 0.1 mm, and more in particular even may become smaller than 0.02 mm. Thus relative inaccuracies of the support bar can be upgraded with a factor 10 for the entire unit.

The support bar and the reference organs can be made out of all kinds of materials. Advantageously it is now possible to make the support bar out of another material than the reference organs. In particular the support bar is made out of a material that is more rigid (higher e-modulus) and/or that is more lightweight and/or that has a lower coefficient of thermal expansion and/or that has a higher thermal conduction compared to the material of the reference organs.

In an embodiment the support bar may be made out of a ceramic material, for example SiC. This is a relative brittle material which is difficult to process, but which at the same time is relative rigid, lightweight and thermally stable, while having a high heat conduction coefficient. Other materials are also possible.

In an embodiment the reference organs may be made out of metal. This is a material that is relative easy to process, and which at the same time is still relative rigid. Other materials are also possible.

In another preferred embodiment the method may further be characterized in that, preceding the step of releasably mounting the printheads to the support bar, reference end blocks are connected to free ends of the support bar and undergo an alignment finishing process for forming reference positioning faces. Those reference positioning faces then amongst others are destined to be placed at complementary bearing points of the printing system. With this the same advantages go as described above for the reference organs, that is to say that any inaccuracies of the support bar's free ends can now easily be lifted to a higher level by the alignment finishing process of the end blocks. The accurately aligned/finished reference positioning faces on the end blocks make it possible to simply hang the entire unit in a printing system by means of free seating. Thus no pulling/pushing or momentum forces get exerted on the support bar. In cases of calamities, like blockings or accumulations of substrates underneath the unit, the support bar together with the print heads mounted thereto can move upwards out of its bearings and/or start to tilt. If desired the reference positioning faces can even be provided with suitable friction reduction or damping means. If desired, seats for the end blocks can also be made adjustable.

In a preferred embodiment the alignment finishing process of the end blocks may be performed such that a dimensional tolerance of the reference positioning faces of the reference end blocks relative to the secondary mounting positions on the reference organs becomes more accurate than a dimensional tolerance of the free ends of the support bar relative to the secondary mounting positions on the reference organs. With dimensional tolerance it is meant here the degree of accuracy with which the positions in x-, y- and/or z-directions of the reference positioning faces and the secondary mounting positions have come to lie relative to each other. For example this can be the accuracy of an aimed interspacing distance in a certain x-, y- and/or z-direction between one of the reference positioning faces and a respective one of the secondary mounting positions. In particular the dimensional tolerances of the free ends may be larger than 0.1 mm, whereas the dimensional tolerances of the reference positioning faces may become smaller than 0.1 mm, and more in particular even may become smaller than 0.02 mm.

Advantageously the alignment finishing processes of the reference end blocks and the alignment finishing process of the reference organs can get performed in a single simultaneous step. The support bar then can remain clamped and positioned in a suitable clamp while both the reference organs and end blocks get accurately positioned and lined up relative to each other during and/or after connection to the support bar. This not only saves time, but in the end, that is to say after the printing bar unit has been placed with its reference positioning faces at complementary bearing points of a printing system, also helps to improve the positioning accuracy of the secondary mounting positions relative to the rest of such a printing system.

In a first variant the alignment finishing process of the reference organs and/or end blocks may comprise a face milling and/or grinding of at least front faces of the reference organs and/or of the aimed reference positioning faces of the end blocks after they have been connected to the support bar. With this it is noted that the support bar itself then does not necessarily get face milled and/or grinded during this step, it may only be the reference organs and/or the end blocks that get to undergo the alignment finishing process.

In a second variant, which in particular may get performed preceding said machining operation like said face milling and/or grinding, the alignment finishing process of the reference organs and/or end blocks may comprise a varying of a thickness of a glue layer, possibly in combination with using one or more filling plates between the support bar and the reference organs and/or end blocks during their connection to the support bar. This then in particular can be obtained by using a glueing jig for accurately positioning the reference organs and/or end blocks to the support bar during the hardening of the glue.

The printheads can be mounted directly onto or against the secondary mounting positions of the reference organs. It is however also possible to mount intermediate adapter elements, like fixing members, to the secondary mounting positions of the reference organs, and to have the printheads releasably mounted, for example screwed or clamped, to those intermediate adapter elements.

Further advantageous embodiments are described herein.

The invention also relates to a printing bar unit, and to a printing system comprising one or more of such printing bar units.

BRIEF DESCRIPTION OF THE DRAWINGS

The invention shall be explained in more detail below with reference to the accompanying drawings, in which.

DETAILED DESCRIPTION OF THE INVENTION

Figure 1A:
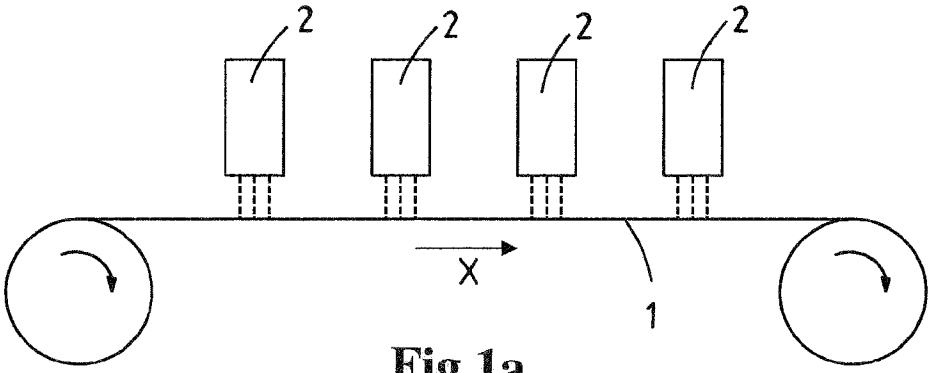
FIGS. 1*a, b* schematically show an inkjet printing system of the single pass type respectively a scanning type system with printing bar units.

In FIGS. 1*a, b* two well-known types of inkjet printing systems are shown. In both cases transportation means are provided for moving a substrate 1 in a printing direction x relative to a plurality of printing bar units 2. The substrate may be of a continuous or discontinuous nature. Each printing bar unit 2 comprises a plurality of exchangeable printheads which are positioned in line or staggered next to each other. Each printhead comprises one or more arrays of individually operable inkjet nozzles for jetting ink droplets onto the substrate 1 when operated.

In FIG. 1*a* the inkjet printing system is of the single pass type. For this each printing bar unit 2 extends in y-direction over an entire width of the substrate 1 and is supported with its free ends at complementary bearing points of the system. With this each unit 2 is used for printing at least one colour onto the substrate 1.

Figure 1B:
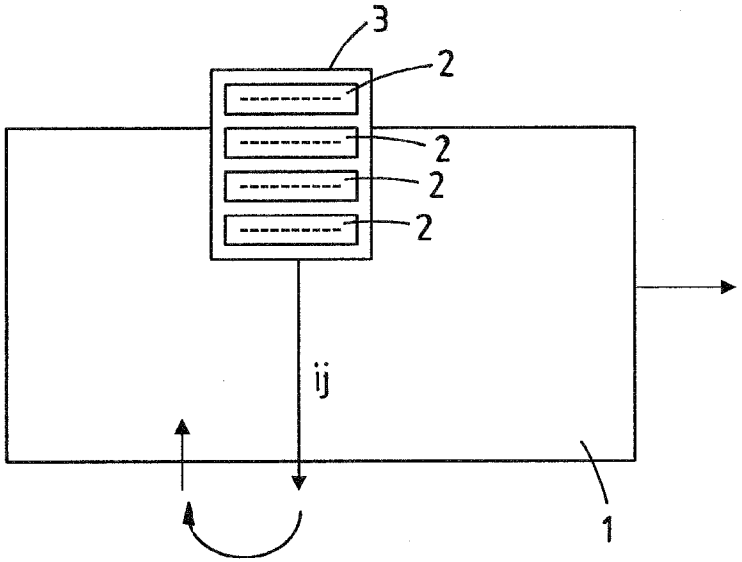
Figure 2A:
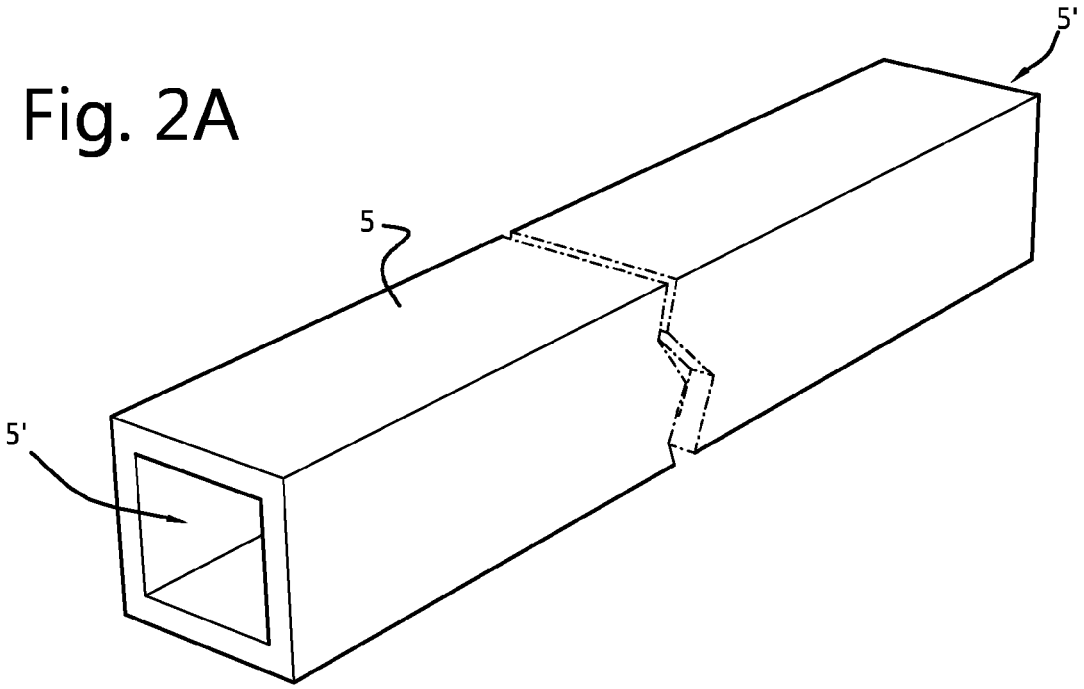
FIGS. 2*a-e* show subsequent manufacturing steps of a first embodiment of the method for manufacturing a printing bar unit according to the invention.
Figure 2B:
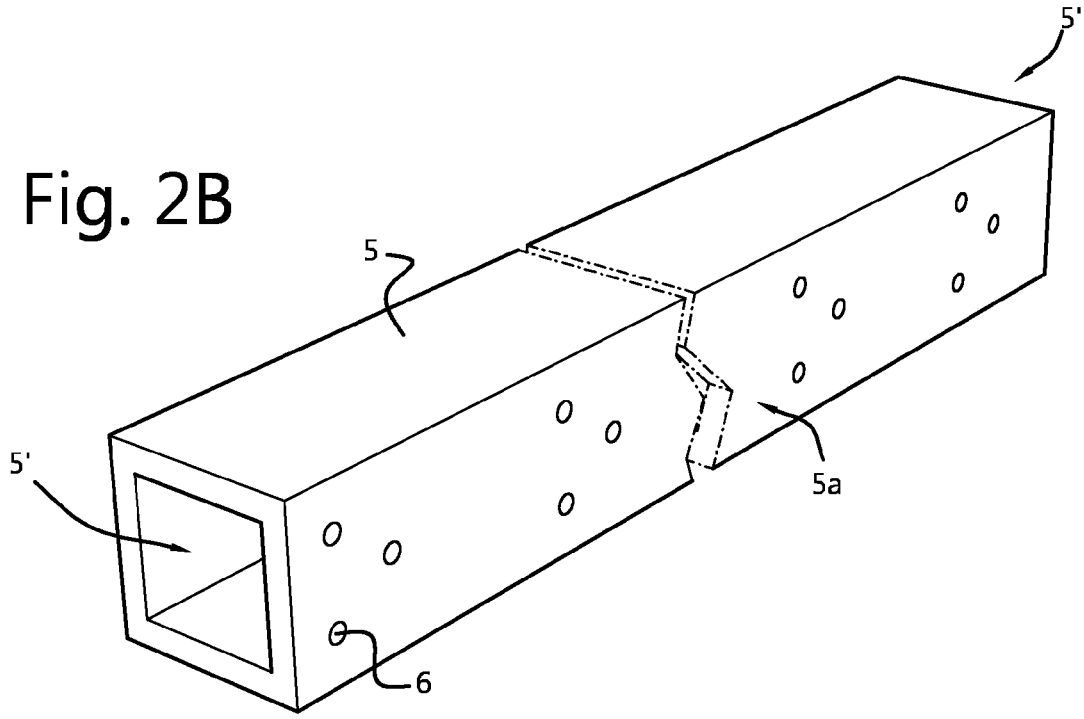
Figure 2C:
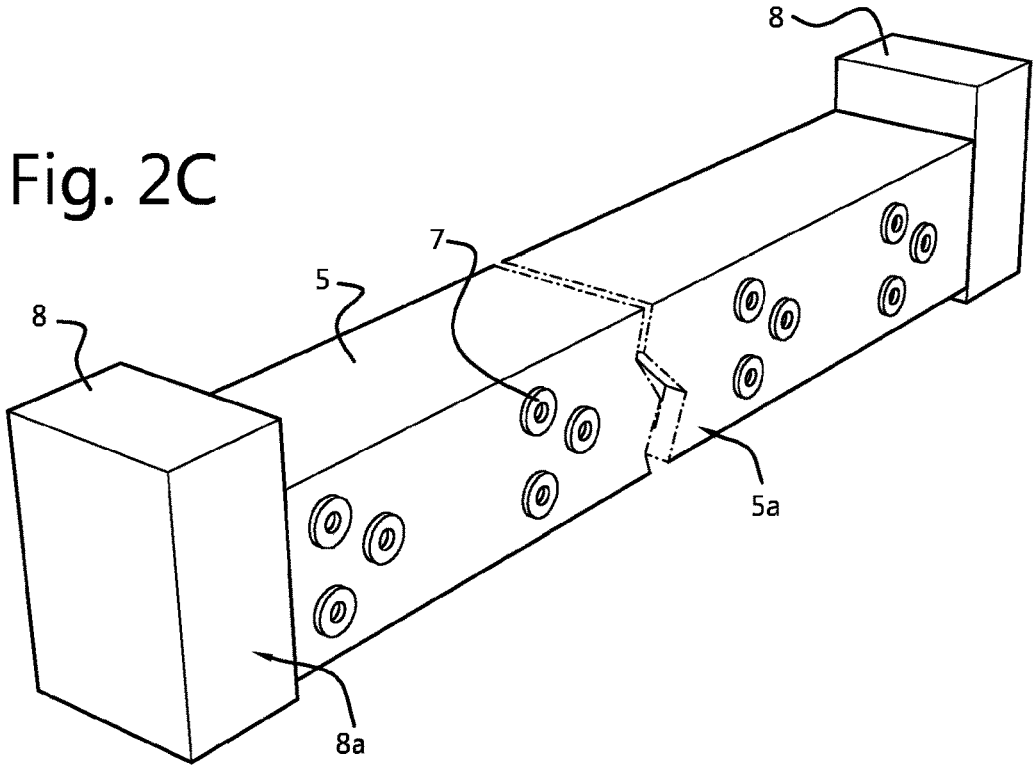
Figure 2D:
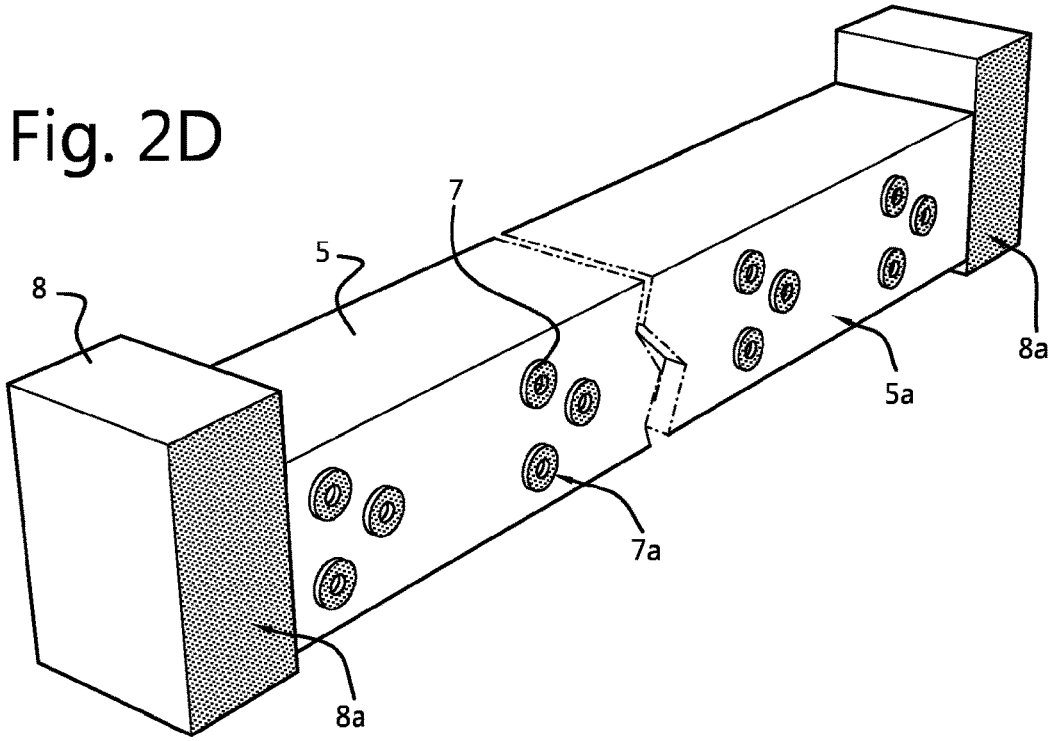
Figure 2E:
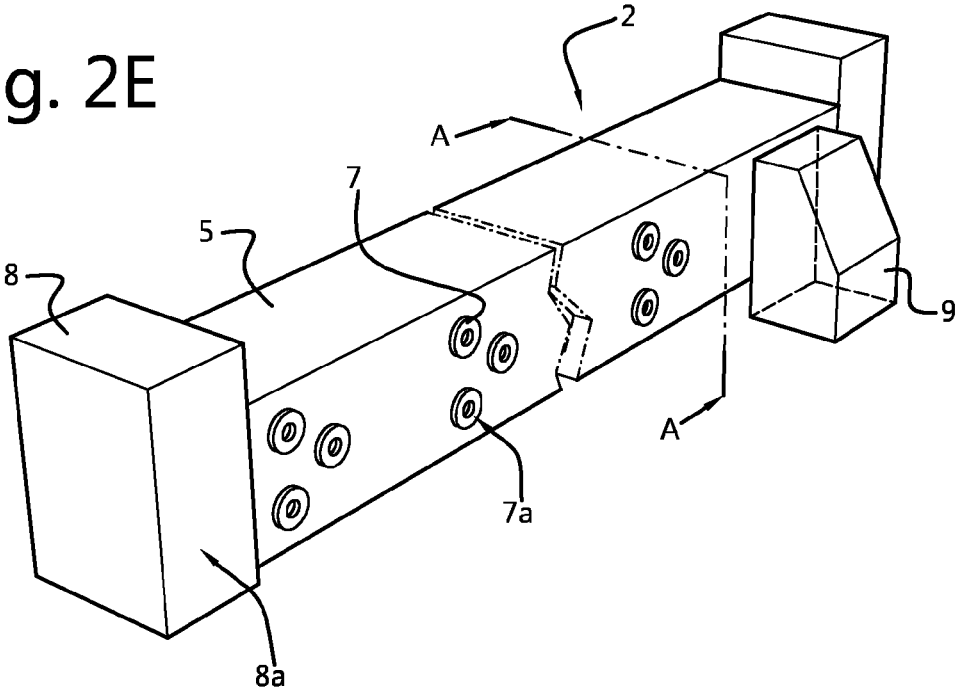

In FIG. 1*b* the inkjet printing system is of the scanning type. For this each printing bar unit 2 has a limited length in x-direction. One or more printing bar units 2 are supported with their free ends at complementary bearing points of a shuttle 3 of the system. The shuttle 3 extends over merely a small part of the width of the substrate 1 in y direction and is movable back and forth in the scanning direction y which is perpendicular to the printing direction x. Here also each unit 2 is used for printing one colour onto the substrate 1.

Figure 3:
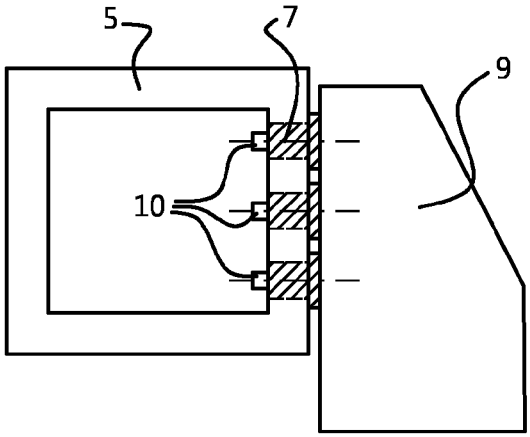
FIG. 3 shows a cross-sectional view over the line A-A in FIG. 2*e;*
Figure 4A:
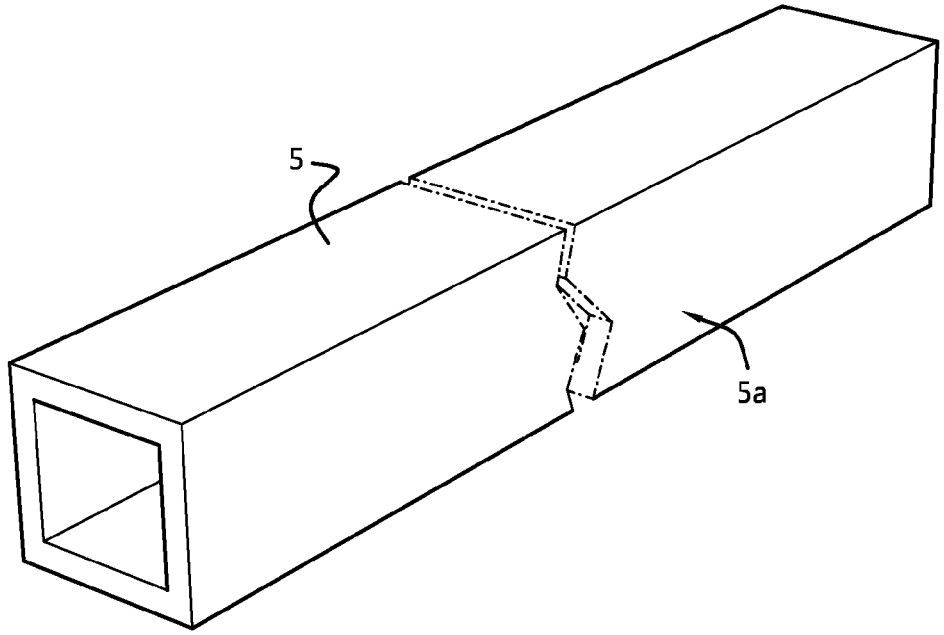
FIGS. 4*a-d* show subsequent manufacturing steps of a second embodiment of the method according to the invention.
Figure 4B:
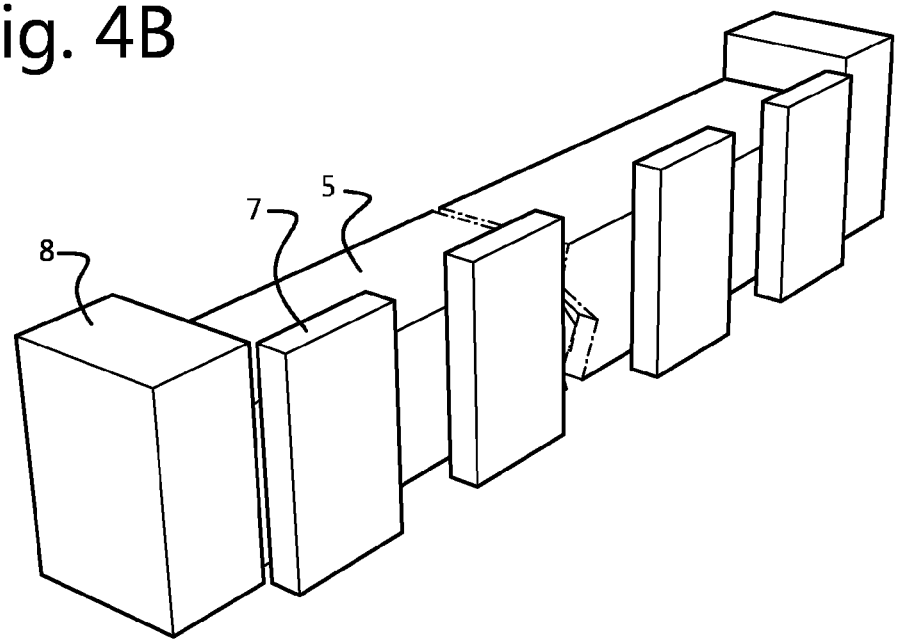
Figure 4B:
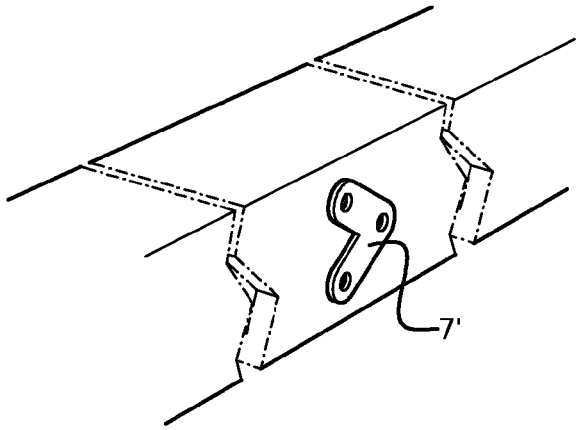
Figure 4B:
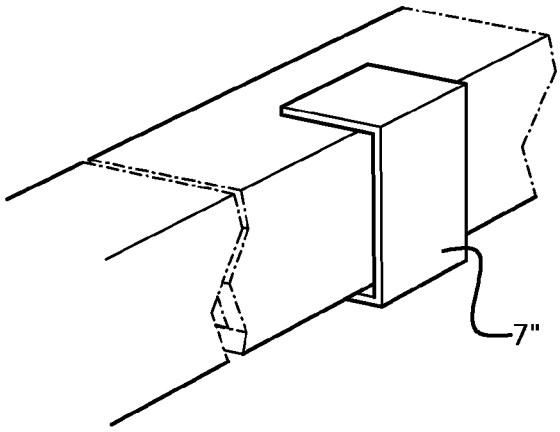
Figure 4B:
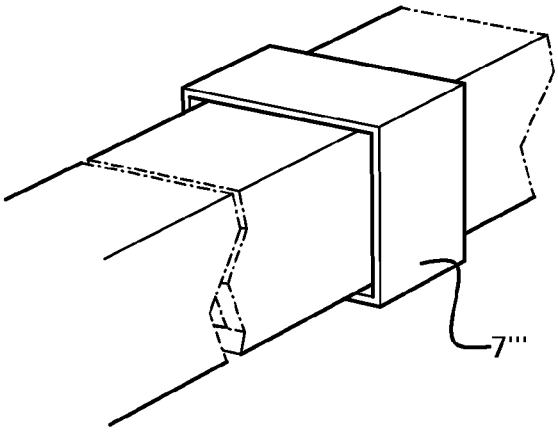
Figure 4C:
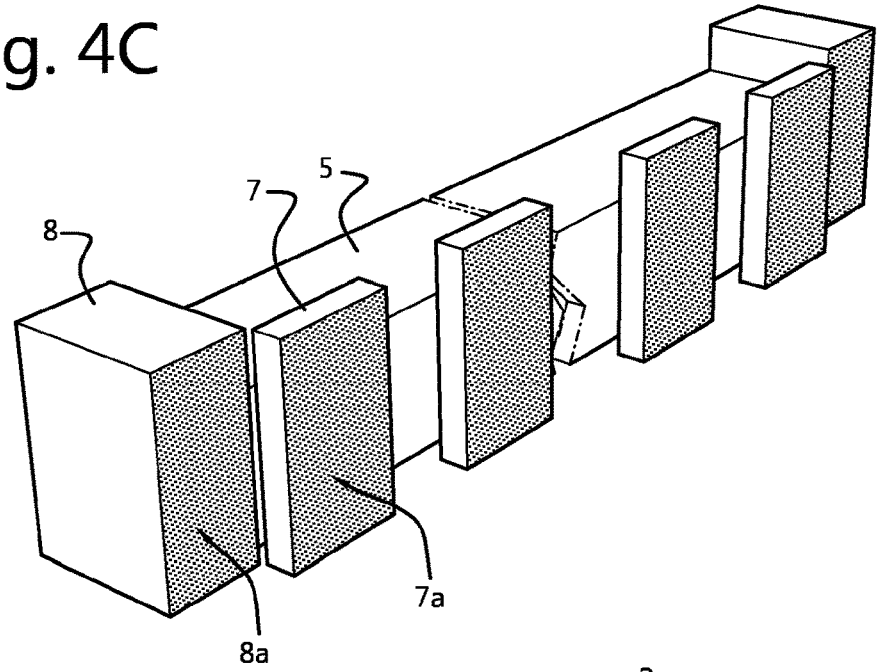
Figure 4D:
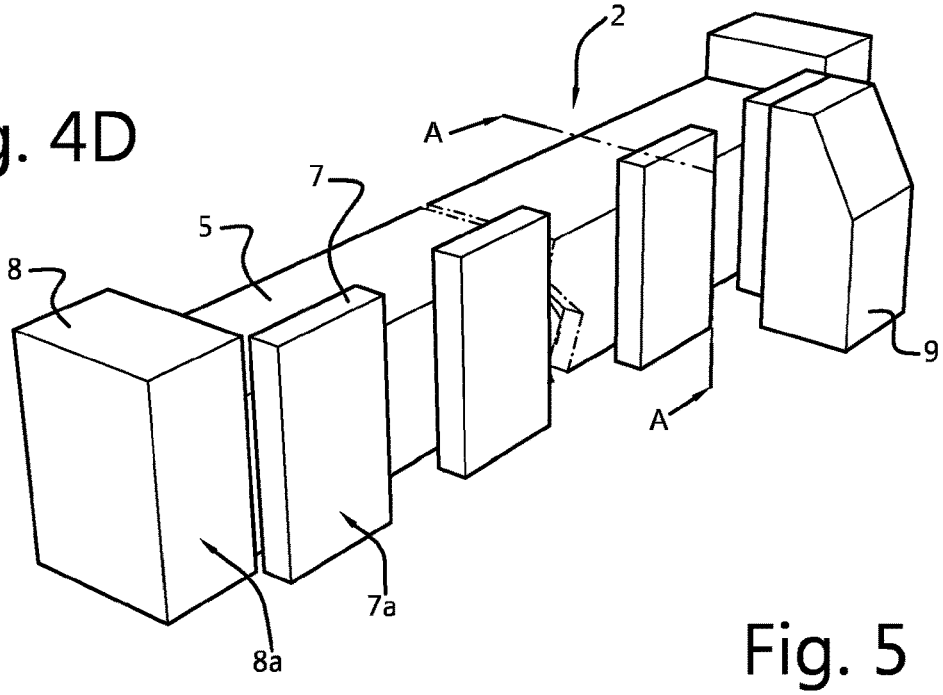

Some different inventive methods for manufacturing the units 2 shall now be explained below with reference to FIGS. 2, 3 and 4.

Starting with FIG. 2. In a first step (see FIG. 2*a*) an elongate piece of base material is taken which forms a support bar 5. The support bar 5 here is a rectangular hollow ceramic beam with free ends 5'. If desired or deemed necessary, it is possible to machine or otherwise process one or more of the outer walls of the bar 5, for example by means of a face milling and/or grinding operation. Thus those faces can be given first dimensional tolerances, which for example can be >0.1 mm, which makes it possible to use them as reference faces for subsequent operations.

In a second step (see FIG. 2*b*), a plurality of primary mounting positions 6 are formed on the bar 5 by drilling holes into a front wall 5*a* thereof. With this use can be made of a drilling jig. It can however also be done manually. Instead of drilling holes through merely one side wall it is also possible to drill them through two opposing side walls of the bar 5.

In a third step (see FIG. 2*c*), reference organs 7 are connected by means of a suitable glue to the bar 5 at the primary mounting positions. With this use can be made of a glueing jig, which shall be explained in more detail below with reference to FIG. 6. The reference organs 7 here are formed by headed metal pins. With this each organ 7 is placed with an insertion part into one of the holes whereas a head part of each organ 7 remains lying projecting outside it.

In this same third step (see FIG. 2*c*), end blocks 8 are connected by means of a suitable glue to the bar 5 at its free ends 5'. With this use can be made of a glueing jig. The end blocks 8 here are metal caps. With this each block 8 comprises a front face 8*a* that is parallel to the wall 5*a*.

In a fourth step (see FIG. 2*d*), the front faces 8*a* of the blocks 8 and front faces 7*a* of the head parts of the organs 7 undergo an alignment finishing process, which here is formed by a face milling and/or grinding operation. Thus those faces 7*a*, 8*a* can be given second dimensional tolerances which are more accurate than the first ones, and for example can be <0.02 mm. The faces 7*a* of the organs 7 then can advantageously be used as accurate secondary mounting positions which have improved dimensional tolerances compared to the ones of the primary mounting positions (from >0.1 mm to <0.02 mm), whereas the faces 8*a* of the blocks 8 can be used as accurate reference positioning faces for placing them at their complementary bearing points of the printing system. Besides having the faces 7*a*, 8*a* undergo the alignment finishing process, it is also possible to have other faces or parts of the organs 7 and/or blocks 8 undergo a same or similar treatment for improving their dimensional tolerances.

In a fifth step (see FIGS. 2*e* and 3), printheads 9 are mounted against the secondary mounting positions that are formed by the aligned/finished faces 7*a* of the reference organs 7. Each printhead 9 here is mounted onto three organs 7 by means of screws 10 which get to extend from behind through holes that are present throughout the entire organs 7. With this use can be made of special positioning equipment and/or procedure, such that the printheads 9 can even be given third dimensional tolerances which may even be more accurate than the second ones, and for example can be <0.005 mm. If desired it is possible to first mount intermediate adapter elements against the secondary mounting positions of the organs 7, and then mount the printheads onto those intermediate adapter elements. As shall be clear, the shape of the reference organs 7 and any intermediate adapter elements, shall be strongly dependent on the type of printhead 9 used and its application.

In FIG. 4 a variant is shown in which same parts have been given same reference numerals. Here in a first step (see FIG. 4*a*) again an elongate piece of base material forms a support bar 5. A plurality of imaginary aimed primary mounting positions 6 are present on a front wall 5*a* of the bar.

In a second step (see FIG. 4*b*), reference organs 7 are connected by means of a suitable glue to the bar 5 at the primary mounting positions. With this use can be made of a glueing jig, which shall be explained in more detail below with reference to FIG. 6. The reference organs 7 here are formed by metal strips. Instead of such metal strips other shapes and profiles are also possible to be glued as reference organs 7 against the bar 5. For example FIG. 4*b'* shows a variant with "boomerang" shaped organs 7', FIG. 4*b"* shows a variant with "clamp" shaped organs 7", and FIG. 4*b'"* shows a variant with "jacket" shaped organs 7'". Moreover, such reference organs may be attached to each other by connections of low stiffness such as not to interfere with the stiffness and thermal expansion of the bar.

In this same second step (see FIG. 4*b*), end blocks 8 are connected by means of a suitable glue to the bar 5 at its free ends 5'. With this use can be made of a glueing jig. The end blocks 8 here again are formed by metal caps.

In a third step (see FIG. 4*c*), the front faces 8*a* of the blocks 8 and front faces 7*a* of the organs 7 undergo an alignment finishing process, which here is formed by a face milling or grinding operation.

Figure 5:
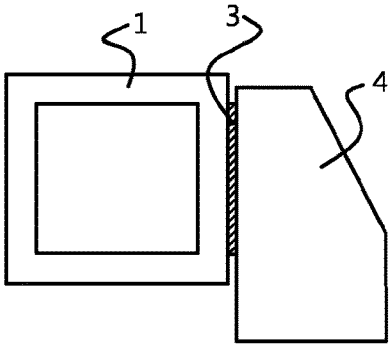
FIG. 5 shows a cross-sectional view over the line A-A in FIG. 4*d*.

In a fourth step (see FIGS. 4*d* and 5), printheads 9 are mounted against the secondary mounting positions that are formed by the aligned/finished front faces 7*a* of the reference organs 7.

Figure 6A:
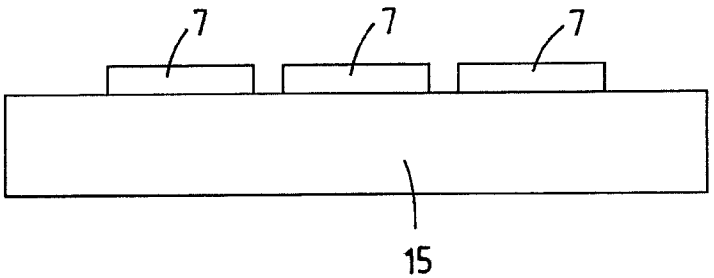
FIGS. 6*a-c* show subsequent manufacturing steps of a third embodiment of the method according to the invention.
Figure 6B:
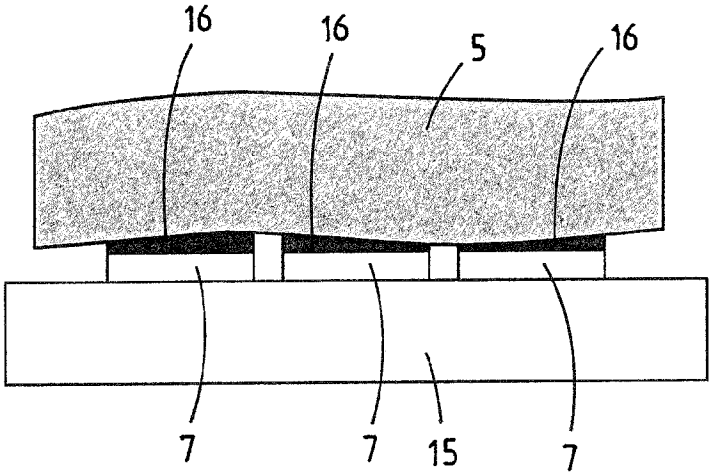
Figure 6C:
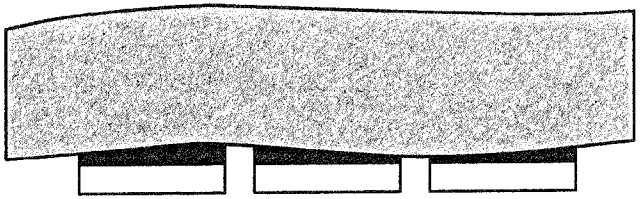

The possible use of the glueing jig in steps 2*c* and 4*b* shall now be explained in more detail with reference to FIG. 6. Firstly (see FIG. 6*a*), the reference organs 7 are accurately placed lined up against a jig 15. Subsequently, the support bar 5, of which the front wall 5*a* has been provided with glue layers 16, is placed against the reference organs 7 on the jig 15. The bar 5 here has been drawn over exaggerated as being somewhat irregularly curved. As can be seen in FIG. 6*b* the glue layer now is well able to overcome those irregular curves of the bar 5 by varying thicknesses of the glue layers 16 between the support bar 5 and the reference organs 7. After the glue layers 16 have sufficiently hardened, it is then possible to remove the jig 15 and start to perform the aimed face milling and/or grinding operations on the reference organs 7. The face milling and/or grinding now can be performed rather quickly because the use of the jig 15 and the varying thicknesses of the glue layers 16 already have improved the accuracy of the organs 7 to a certain extent.

Besides the embodiments shown, numerous variants are possible. For example the materials, various dimensions and/or shapes of the distinctive components may differ. Instead of drilling holes in the support bar, it is also possible to already provide those holes in the support bar during manufacturing thereof. If for example the support bar is made out of ceramic material, then the holes can already be made therein while the ceramic material is still in its green phase. Despite the fact that such holes then are likely to be rather inaccurate because of shrinkages of the material during hardening, this is no problem, since according to the invention, the position accuracy of the printheads on the support bar can be greatly and easily improved during the subsequent connection and alignment finishing process of the reference organs. Instead of using a rectangular hollow beam as support bar, it is also possible to use a strip-shaped, T-shaped or L-shaped support bar or any other profile. This shall be dependent on the type of printheads that need to be mounted thereto and on the required rigidity. In the case of the hollow beam, the hollow inside the beam may be used for supplying fluids such as inks and/or steering signals, and/or gasses towards and from the respective printheads and their neighbourhood. Instead of glueing or otherwise connecting reference organs to the support bar that already comprise a through-going mounting opening therein, it is also possible to accurately drill such through-going mounting openings in the reference organs during the alignment finishing process. This then makes it possible to obtain through-going mounting openings with improved dimensional tolerances relative to the ones of the support bar with its first mounting positions. Instead of glueing, the organs and/or blocks can also be connected in other manners to the support bar, for example by clamping or screwing. It is also possible to obtain the support bar by means of a 3D-printing operation. In the alternative or in addition thereto it is also possible to perform a 3D-printing operation for making the reference organs on top of the support bar. Those 3D-printed reference organs then can be printed out of another material than the support bar, and those 3D-printed reference organs then in a subsequent step can undergo the alignment finishing operation according to the invention.

Thus according to the invention a manufacturing method and printing bar unit is obtained with which reference positioning faces and mounting positions for printheads can be optimally defined relative to each other, while being able to use all kinds of support bars, even ones which are rather inaccurate in their dimensions and which are difficult to directly machine such that they get more accurately defined. The invention advantageously can be used for both single pass and scanning types of printing systems, and for example can be used in the field of textile printing, décor printing, packaging printing, label printing, document printing above a flat track or above a curved track on which a continuous or discontinuous substrate is transported. When used in single pass printing systems, the printing bar unit according to the invention can advantageously form an elongate linehead, in particular one having a length of at least 1.0 meter which gets equipped with tens of printheads in line or staggered next to each other. Even at such long lengths, very high accuracies can be obtained for the positioning of the printheads. When used in scanning printing systems, the printing bar unit according to the present invention can advantageously also be formed with relative long support bars such that wider strokes can be made in one scanning movement of a shuttle to which the printing bar units are mounted.

The invention claimed is:

1. A method for manufacturing a printing bar unit for a printing system, the method comprising the steps of:

providing a support bar having a plurality of primary mounting positions;

providing a plurality of exchangeable printheads, each printhead having a plurality of inkjet nozzles; and releasably mounting the printheads to the support bar, wherein preceding the step of releasably mounting the printheads to the support bar, a plurality of reference organs are connected at the primary mounting positions to the support bar and undergo an alignment finishing process for forming a plurality of secondary mounting positions, and then in a subsequent step the printheads are releasably mounted to the secondary mounting positions on the reference organs, wherein the alignment finishing process comprises a machining operation.

2. The method according to claim 1, wherein the machining operation comprises face milling and/or grinding.

3. A printing bar unit for a printing system manufactured with a method according to claim 1, the printing bar unit comprising:

a support bar having a plurality of primary mounting positions;

reference organs connected at the primary mounting positions to the support bar and forming secondary mounting positions; and a plurality of exchangeable printheads, each printhead having a plurality of inkjet nozzles, and the printheads being releasably mounted to the reference organs, wherein a dimensional tolerance of the secondary mounting positions on the reference organs relative to each other is more accurate than a dimensional tolerance of the primary mounting positions on the support bar relative to each other, and wherein the reference organs have undergone an alignment finishing process comprising a machining operation.

4. The printing bar unit according to claim 3, wherein the machining operation comprises face milling and/or grinding.

5. The printing bar unit according to claim 3, wherein at least front faces of the reference organs have undergone the alignment finishing process comprising the machining operation.

6. A printing bar unit for a printing system manufactured with a method according to claim 1, the printing bar unit comprising:

a support bar having a plurality of primary mounting positions;

reference organs connected at the primary mounting positions to the support bar and forming secondary mounting positions; and a plurality of exchangeable printheads, each printhead having a plurality of inkjet nozzles, and the printheads being releasably mounted to the reference organs, wherein a dimensional tolerance of the secondary mounting positions on the reference organs relative to each other is more accurate than a dimensional tolerance of the primary mounting positions on the support bar relative to each other, and wherein the reference organs are made out of metal.

7. A printing system comprising one or more printing bar units manufactured with a method according to claim 1 and that each comprise:

a support bar having a plurality of primary mounting positions;

reference organs connected at the primary mounting positions to the support bar and forming secondary mounting positions; and a plurality of exchangeable printheads, each printhead having a plurality of inkjet nozzles, and the printheads being releasably mounted to the reference organs, wherein a dimensional tolerance of the secondary mounting positions on the reference organs relative to each other is more accurate than a dimensional tolerance of the primary mounting positions on the support bar relative to each other, wherein the reference organs have undergone an alignment finishing process comprising a machining operation.

8. A method for manufacturing a printing bar unit for a printing system, the method comprising the steps of:

providing a support bar having a plurality of primary mounting positions;

providing a plurality of exchangeable printheads, each printhead having a plurality of inkjet nozzles; and releasably mounting the printheads to the support bar, wherein preceding the step of releasably mounting the printheads to the support bar, a plurality of reference organs are connected at the primary mounting positions to the support bar and undergo an alignment finishing process for forming a plurality of secondary mounting positions, and then in a subsequent step the printheads are releasably mounted to the secondary mounting positions on the reference organs, and wherein the alignment finishing process of the reference organs is performed such that a dimensional tolerance of the secondary mounting positions on the reference organs relative to each other becomes more accurate than a dimensional tolerance of the primary mounting positions on the support bar relative to each other.

9. A printing bar unit for a printing system manufactured with a method according to claim 8, the printing bar unit comprising:

a support bar having a plurality of primary mounting positions;

reference organs connected at the primary mounting positions to the support bar and forming secondary mounting positions; and a plurality of exchangeable printheads, each printhead having a plurality of inkjet nozzles, and the printheads being releasably mounted to the reference organs, wherein a dimensional tolerance of the secondary mounting positions on the reference organs relative to each other is more accurate than a dimensional tolerance of the primary mounting positions on the support bar relative to each other, and wherein the support bar is made out of another material than material for the reference organs.

10. The printing bar unit according to claim 9, wherein the another material of the support bar has a lower coefficient of thermal expansion and/or has a higher thermal conduction and/or has a higher e-modulus and/or is more lightweight compared to the material of the reference organs.

11. A method for manufacturing a printing bar unit for a printing system, the method comprising the steps of:

providing a support bar having a plurality of primary mounting positions;

providing a plurality of exchangeable printheads, each printhead having a plurality of inkjet nozzles; and releasably mounting the printheads to the support bar, wherein preceding the step of releasably mounting the printheads to the support bar, a plurality of reference organs are connected at the primary mounting positions to the support bar and undergo an alignment finishing process for forming a plurality of secondary mounting positions, and then in a subsequent step the printheads are releasably mounted to the secondary mounting positions on the reference organs, and wherein preceding the step of releasably mounting the printheads to the support bar, reference end blocks are connected to free ends of the support bar and undergo an alignment finishing process for forming reference positioning faces destined to be placed at complementary bearing points of the printing system.

12. The method according to claim 11, wherein the alignment finishing process of the end blocks is performed such that a dimensional tolerance of the reference positioning faces of the reference end blocks relative to the secondary mounting positions on the reference organs becomes more accurate than a dimensional tolerance of the free ends of the support bar relative to the secondary mounting positions on the reference organs.

13. The method according to claim 11, wherein the alignment finishing processes of the reference end blocks and the reference organs get performed in a single simultaneous step.

14. The method according to claim 11, wherein the alignment finishing process comprises face milling and/or grinding of at least front faces of the reference organs and/or of the reference positioning faces of the end blocks.

15. The method according to claim 11, wherein the reference organs and/or end blocks are glued with a glue layer to the support bar.

16. The method according to claim 15, wherein the alignment finishing process comprises a varying of a thickness of the glue layer between the support bar and the reference organs and/or end blocks particular by using a glueing jig for positioning the reference organs and/or end blocks to the support bar.

17. A printing bar unit for a printing system manufactured with a method according to claim 11, the printing bar unit comprising:

a support bar having a plurality of primary mounting positions;

reference organs connected at the primary mounting positions to the support bar and forming secondary mounting positions; and a plurality of exchangeable printheads, each printhead having a plurality of inkjet nozzles, and the printheads being releasably mounted to the reference organs, wherein a dimensional tolerance of the secondary mounting positions on the reference organs relative to each other is more accurate than a dimensional tolerance of the primary mounting positions on the support bar relative to each other, wherein the printing bar unit further comprises:

reference end blocks that connect to free ends of the support bar, and wherein a dimensional tolerance of the reference positioning faces of the reference end blocks relative to the secondary mounting positions on the reference organs is more accurate than a dimensional tolerance of the free ends of the support bar relative to the secondary mounting positions on the reference organs.

18. The printing bar unit according to claim 17, wherein the reference end blocks have undergone an alignment finishing process comprising a machining operation for forming reference positioning faces destined to be placed at complementary bearing points of the printing system.

19. The printing bar unit according to claim 18, wherein at least the reference positioning faces of the end blocks have undergone the alignment finishing process comprising the machining operation.

20. The printing bar unit according to claim 17, wherein the dimensional tolerance of the free ends is larger than 0.1 mm and wherein the dimensional tolerance of the reference positioning faces is smaller than 0.1 mm.

21. A method for manufacturing a printing bar unit for a printing system, the method comprising the steps of:

providing a support bar having a plurality of primary mounting positions;

providing a plurality of exchangeable printheads, each printhead having a plurality of inkjet nozzles; and releasably mounting the printheads to the support bar, wherein preceding the step of releasably mounting the printheads to the support bar, a plurality of reference organs are connected at the primary mounting positions to the support bar and undergo an alignment finishing process for forming a plurality of secondary mounting positions, and then in a subsequent step the printheads are releasably mounted to the secondary mounting positions on the reference organs, and wherein intermediate adapter elements are mounted to the secondary mounting positions of the reference organs, and wherein the printheads are mounted to those intermediate adapter elements.

22. A printing bar unit for a printing system manufactured with a method according to claim 21, the printing bar unit comprising:

a support bar having a plurality of primary mounting positions;

reference organs connected at the primary mounting positions to the support bar and forming secondary mounting positions; and a plurality of exchangeable printheads, each printhead having a plurality of inkjet nozzles, and the printheads being releasably mounted to the reference organs, wherein a dimensional tolerance of the secondary mounting positions on the reference organs relative to each other is more accurate than a dimensional tolerance of the primary mounting positions on the support bar relative to each other, and wherein intermediate adapter elements have been mounted to the secondary mounting positions of the reference organs, and wherein the printheads have been mounted to those intermediate adapter elements.

* * * * *